US007537132B2

(12) United States Patent
Marple et al.

(10) Patent No.: US 7,537,132 B2
(45) Date of Patent: May 26, 2009

(54) TAMPER EVIDENT PLUG AND COMBINATION

(75) Inventors: C. Scott Marple, Naperville, IL (US); Carl Pomilia, Addison, IL (US); Cornelis Van De Klippe, West Chicago, IL (US)

(73) Assignee: American Flange & Mfg. Co., Inc., Carol Stream, IL (US)

( * ) Notice: Subject to any disclaimer, the term of this patent is extended or adjusted under 35 U.S.C. 154(b) by 728 days.

(21) Appl. No.: 10/922,200

(22) Filed: Aug. 20, 2004

(65) Prior Publication Data

US 2006/0037958 A1 Feb. 23, 2006

(51) Int. Cl.
*B65D 17/50* (2006.01)
*B65D 41/46* (2006.01)
*B65D 41/48* (2006.01)

(52) U.S. Cl. ..... 220/254.7; 220/276; 220/789

(58) Field of Classification Search ..... 220/254.7, 220/254.1, 276, 266, 906, 257.1, 789, 780; 215/256, 901
See application file for complete search history.

(56) References Cited

U.S. PATENT DOCUMENTS

| | | | | |
|---|---|---|---|---|
| 2,784,865 A | | 3/1957 | Rieke | |
| 3,021,976 A | * | 2/1962 | Tracy | 220/619 |
| 3,250,428 A | | 5/1966 | Rieke | |
| 3,717,324 A | | 2/1973 | Milde | |
| 4,387,818 A | | 6/1983 | Conti | |
| 4,422,563 A | * | 12/1983 | Babiol | 222/153.09 |
| 4,632,282 A | * | 12/1986 | Nagashima | 222/529 |
| 4,682,707 A | * | 7/1987 | Wiles | 220/789 |
| 4,785,963 A | * | 11/1988 | Magley | 220/266 |
| 5,249,695 A | * | 10/1993 | Luch et al. | 220/276 |
| 5,348,182 A | * | 9/1994 | Luch | 220/258.3 |
| 5,799,813 A | * | 9/1998 | Letica | 220/254.1 |
| 5,823,377 A | * | 10/1998 | Krautkramer | 220/268 |
| 6,360,908 B1 | | 3/2002 | Kline | |
| 7,207,457 B2 | * | 4/2007 | Schwarz | 220/276 |
| 2005/0121451 A1 | * | 6/2005 | Van Bruggen | 220/257.2 |

* cited by examiner

*Primary Examiner*—Anthony D Stashick
*Assistant Examiner*—Niki M Eloshway
(74) *Attorney, Agent, or Firm*—Baker & Hostetler LLP

(57) ABSTRACT

A plastic integrally molded single use sealing plug for permanently closing off the center fill opening in metal lids surrounded by an upstanding neck having an inward curl terminating in a free edge. The sealing plug has a circular top wall and a depending cylindrical sidewall which makes at tight friction fit with the neck free edge. A peripheral tamper evident ring is connected to the plug sidewall by a series of frangible connecting webs.

8 Claims, 2 Drawing Sheets

TAMPER EVIDENT PLUG AND COMBINATION

BACKGROUND OF THE INVENTION

This invention is directed to a tamper evident sealing plug for insertion in metal can lids.

The packaging of liquid products and particularly comestibles such as edible oil is commonly done in 4 liter cylindrical cans. This very rugged but relatively inexpensive packaging is used for high volume shipments to third world countries. The circular can top is formed with a center opening for the most efficient high speed filling operation. Following the filling step a closure fitment is inserted in the fill opening and retained therein by means of a friction fit to complete the package. The prior art closure construction heretofore employed for this use has provided a retractable plastic pour spout closed off by an integrally molded membrane and having an overlying screw cap to enable extension of the spout to pouring position and for reclosing. In one principal application of this packaging construction used in supplying edible oil to impoverished populations, it has been brought to light that most frequently the can is opened for pouring by simply punching two diametrically opposed pouring and vent openings in the top of the can adjacent the can sidewall. The reasons for this are rather obvious. To pour from a very short spout positioned in the center of the can top results in nothing short of a mess with oil all over the top of the can. Moreover, cutting off the membrane sealed top of the spout with a knife that may be readily available, is more than likely a very unsanitary exercise. Reclosing, as a practical matter, is rarely practiced. Bearing all this in mind, the unavoidable cost of a two piece spout and cap closure does not seem justified. In addition, and perhaps most importantly, the prior art spout and cap construction while offering some unnecessary features, fails to provide what is perceived today as the most essential feature. Tamper evidence is now considered paramount for food packaging distributed in the instant environment. An undetectable prying off of the closure and subsequent replacement renders the acceptability of the food packaging improbable.

SUMMARY OF THE INVENTION

The invention overcomes these prior art deficiencies that have manifested themselves in actual use and taken a completely different tact. Instead of providing a recloseable pouring spout of questionable utility, this invention in contrast discloses a one piece sealing plug that is pushed into the can top center opening after filling, creating a permanent friction fit therewithin. The resulting sealing plug can lid combination is an effective barrier against product leakage while allowing the end user to decant the liquid contents in the commonly practiced manner of puncturing the can lid for optimum pouring. A distinguishing attribute of the invention sealing plug, however, is a tamper evident feature significantly enhancing the security of the package. This consists of a peripheral band surrounding the sealing plug and integrally connected thereto by a series of frangible webs. This tamper evident band is configured in such a fashion as to preserve the structural integrity of the part thus avoiding accidental rupturing of the frangible webs during insertion in the suitably reinforced can lid while at the same time assuring such rupturing of the webs with any attempt to pry the sealing plug out of the lid opening.

It is accordingly a principal object of this invention to provide a new sealing plug can end combination.

Another object is to provide a one piece, single use sealing plug for metal cans.

A further object is to provide a new and improved tamper evident sealing plug for use on comestible packaging.

Further and more detailed objects will in part be obvious and in part pointed out as the description of the invention taken in conjunction with the accompanying drawing proceeds.

Figure 1:
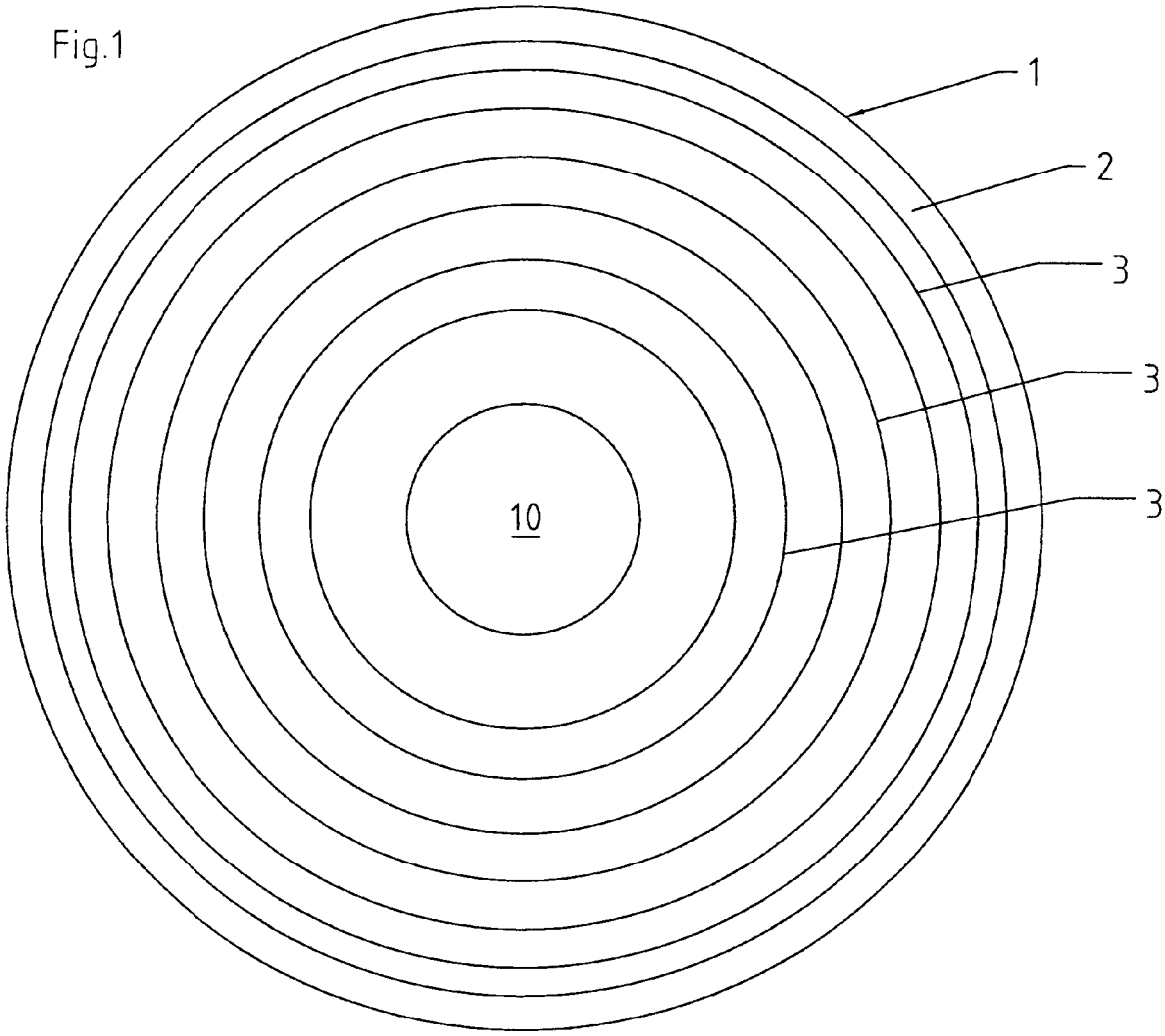
FIG. 1 shows a top plan view of the can end and sealing plug combination in accordance with the invention.
Figure 2:
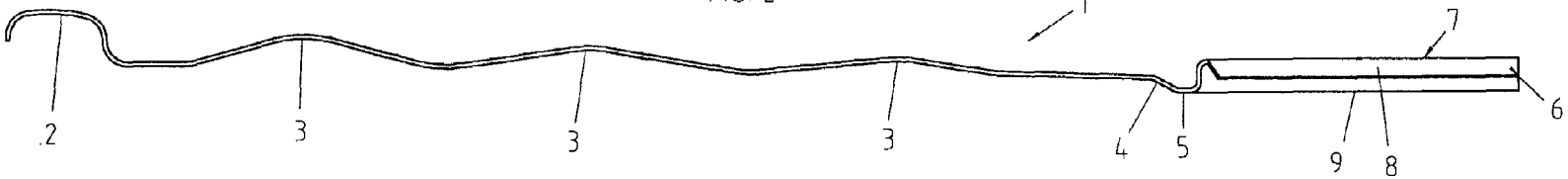
FIG. 2 shows a partial vertical cross sectional view of the can end.

The sealing plug can lid combination is shown in FIG. 1 wherein numeral 1 indicates the can lid having a peripheral chime 2 which is formed for seaming onto a can body. The can lid surface is essentially flat as seen in FIG. 2 and is formed with a series of concentric stiffening ribs as indicated at 3. Three such stiffening ribs are shown with the can lid then sloping down at 4 into an annular recess 5 surrounding a cylindrical upstanding opening neck 6. The neck extends substantially vertically upwardly from the bottom of recess 5 and has an inward curl 7 which extends radially inwardly and downwardly at 8 terminating in a circular free edge 9.

Figure 3:
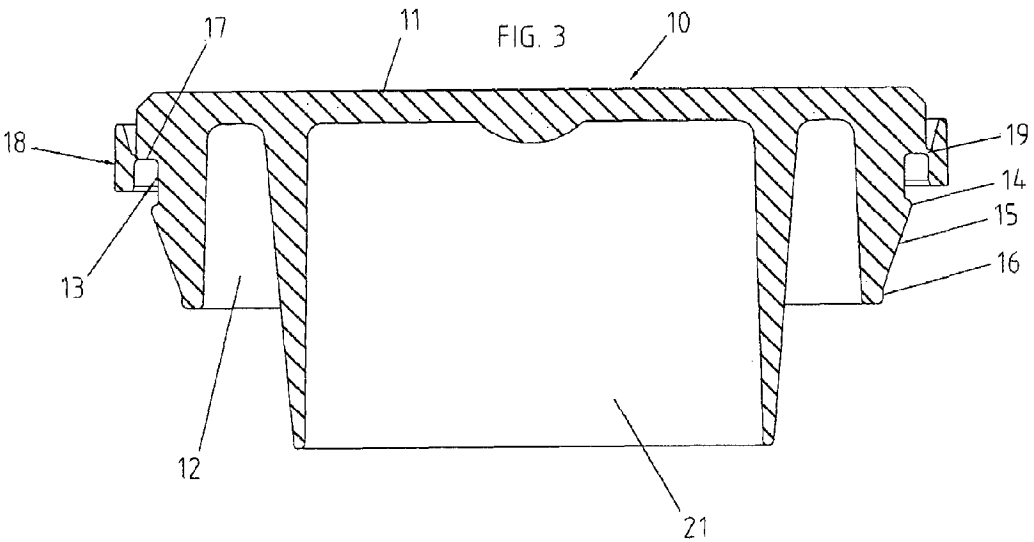
FIG. 3 shows a vertical cross sectional view of the sealing plug of the invention.

The sealing plug 10 clearly shown in FIG. 3 is molded of a synthetic plastic resin such as low density polyethylene as a nonlimiting example and consists of a circular top wall 11 and a depending cylindrical sidewall 12. The exterior of the sidewall is formed with a cylindrical neck engaging band 13. Immediately below the band 13 is a circumferentially enlarged locking bead 14. The plug sidewall then extends downwardly and radially inwardly in a conical guide surface 15 terminating in a short cylindrical pilot portion 16. At the uppermost end of the sealing band 13 the plug sidewall 12 extends radially outwardly creating an annular overhang 17. The sealing plug 10 is further provided with a peripheral tamper evident ring generally indicated at 18 integrally connected to the plug sidewall by a series of frangible connecting webs 19 extending radially outwardly from the sidewall overhang 17. The tamper evident ring 18 extends downwardly at **18*a* from the connecting webs 19 in radially spaced relationship to the sealing band 13 terminating above the bead 14. The ring 18 also extends upwardly at 18*b* from the webs 19 at an upward and radially outward angle creating a "V" shaped upwardly opening groove 20 surrounding the sealing plug sidewall and lying below the plane of the top wall 10. Depending from the undersurface of the top wall 10 is a further elongated inner cylindrical wall 21**.

Figure 4:
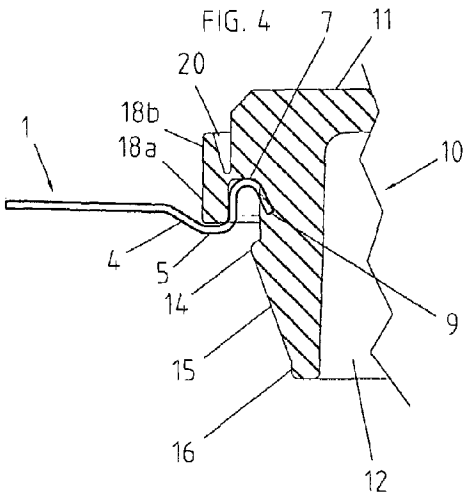
FIG. 4 shows an enlarged fragmentary vertical cross sectional view of the sealing plug can end engagement.

Assembly of the sealing plug to the lid after the can filling operation is accomplished by insertion of the pilot portion 16 on the plug sidewall within the lid opening neck 6. As seen in FIG. 4 downward pressure, resisted by the lid stiffening ribs 3, forces the conical guide surface 15 and the locking bead 14 past the opening neck free edge 9 which then digs into the sealing band 13. At the same time the lower portion **18*a* of the tamper evident sealing ring 18 tightly surrounds the upstanding opening neck 6. However, any radial expansion of the lower ring portion 18*a* that may occur during the insertion operation causes the band to slightly pivot about the sidewall overhang 17 closing up the "V" shaped groove 20 thus avoiding accidental rupture of the connecting webs 19. In fully inserted position, the sidewall overhang 17 can then be seen to rest on top of the neck curl 7 and with the lower band portion 18***a* seated within the upwardly opening groove 5 surrounding the neck 6.

The filled can is thus tightly sealed against leakage under normally encountered shipping, handling and storage conditions. In addition, any tampering or other attempt at unauthorized access is effectively thwarted by the presence of the tamper evident ring which blocks access to the sealing plug sidewall with any kind of pry out implement. Any such attempt to pry the plug past the locking bead 14 would severely damage the plug and clearly rupture the frangible connecting webs rendering undetectable replacement of the sealing plug within the can lid extremely unlikely.

Various other changes in or modifications of the sealing plug and combination of the invention would suggest themselves to those skilled in the art and could be made without departing from the spirit or scope of the invention. For example, the sealing plug could be molded of other plastic resins or the sealing plug could be inserted in the can lid and the lid then seamed onto the filled can. It is accordingly intended that all matter contained in the above description or shown in the accompanying drawing shall be interpreted as being illustrative and not in a limiting sense.

We claim:

1. A single use sealing plug integrally molded from synthetic plastic resin for insertion in a metal can end, said sealing plug comprising a circular top wall, a cylindrical sidewall depending from said top wall, the exterior of said sidewall having an upper substantially cylindrical sealing band, a circumferentially enlarged annular locking bead immediately below said sealing band extending radially outwardly therefrom, a conical guide surface extending downwardly and radially inwardly from said locking bead terminating in a short lead in cylindrical pilot portion, said sidewall extending radially outwardly forming an annular overhang immediately above said sealing band and a circumferential tamper evident ring closely surrounding said sidewall integrally connected thereto by a frangible connecting web extending radially outwardly from said annular overhang, said tamper evident ring radially spaced from said sealing band extending downwardly below said connecting web terminating above said locking bead.

2. A sealing plug as in claim 1 and said tamper evident ring extending upwardly and radially outwardly from said sidewall above said connecting web forming an upwardly opening "V" shaped groove.

3. A sealing plug can end combination solely comprising a unitary sealing plug and a circular metal can end, said metal can end having a series of concentric stiffening ribs surrounding a circular center opening, an upstanding neck surrounding said opening, said neck formed with an uppermost inward curl extending radially inwardly and downwardly and terminating in a circular free edge, said sealing plug being directly and permanently inserted within said opening and having a circular top wall, a cylindrical sidewall depending from said top wall, an exterior facing sealing band in sealing engagement with said neck free edge, said sidewall extends radially outwardly in an annular overhang above said sealing band and is seated on said neck curl, a tamper evident ring closely surrounding said sidewall integrally connected to said sidewall by a frangible connecting web and tightly surrounding said upstanding neck.

4. A sealing plug can end combination as in claim 3 and an annular recess immediately surrounding said upstanding neck.

5. A sealing plug combination as in claim 4 and said tamper evident ring seated within said recess.

6. A sealing plug can end combination as in claim 3 wherein said frangible connecting web is vertically aligned with said upstanding neck.

7. A sealing plug can end combination as in claim 3 said tamper evident ring extending upwardly and radially outwardly from said sidewall above said connecting web forming an upwardly opening "V" shaped groove.

8. A sealing plug can end combination as in claim 3 said circular free edge digging into said sealing band.

* * * * *